US005420570A

United States Patent [19]

Leitten et al.

[11] Patent Number: 5,420,570

[45] Date of Patent: * May 30, 1995

[54] MANUALLY ACTUATABLE WRIST ALARM HAVING A HIGH-INTENSITY SONIC ALARM SIGNAL

[75] Inventors: Brian J. Leitten, Batesville, Ind.; Gary L. Claypoole, Westchester, Ohio; Dennis J. Gallant, Harrison, Ohio; Elvin D. Stepp, Hamilton, Ohio; Kenneth R. Umans, Centerport, N.Y.

[73] Assignee: K & B Protection, Inc., Batesville, Ind.

[ * ] Notice: The portion of the term of this patent subsequent to Nov. 2, 2010 has been disclaimed.

[21] Appl. No.: 146,709

[22] Filed: Nov. 1, 1993

Related U.S. Application Data

[63] Continuation of Ser. No. 800,378, Dec. 3, 1991, Pat. No. 5,258,746.

[51] Int. Cl.[6] ..... G08B 13/00

[52] U.S. Cl. ..... 340/574; 340/384.6; 340/693; 368/10

[58] Field of Search ..... 340/574, 384.7, 384.73, 340/388.1, 391.1; 368/10–12, 243, 255, 259; 331/64–65

[56] References Cited

U.S. PATENT DOCUMENTS

| | | | |
|---|---|---|---|
| 3,668,860 | 6/1972 | Diersbock | 368/204 |
| 3,733,804 | 5/1973 | Diersbock | 340/384 E X |
| 4,121,160 | 10/1978 | Cataldo | 340/321 |
| 4,158,197 | 6/1979 | Takagaki | 340/574 |
| 4,325,058 | 4/1982 | Wagner et al. | 340/562 |
| 4,352,169 | 9/1982 | Asano | 340/384 E X |
| 4,535,324 | 8/1985 | Levental | 340/574 |
| 4,591,836 | 5/1986 | Feigenblatt, Jr. et al. | 340/574 |
| 4,692,749 | 9/1987 | Bussing, Jr. | 340/574 |
| 4,694,284 | 9/1987 | Leveille et al. | 340/574 |
| 4,719,454 | 1/1988 | Hopkins et al. | 340/574 |
| 4,788,532 | 11/1988 | Maldonado | 340/574 |
| 4,806,911 | 2/1989 | Petri | 340/574 |
| 4,959,637 | 9/1990 | Woods et al. | 340/573 |
| 5,005,002 | 4/1991 | Halperin | 340/574 |
| 5,032,824 | 7/1991 | Corbin | 340/574 |
| 5,075,671 | 12/1991 | Livingston, III | 340/574 |
| 5,258,746 | 11/1993 | Leitten et al. | 340/574 |

*Primary Examiner*—John K. Peng
*Assistant Examiner*—Thomas J. Mullen, Jr.
*Attorney, Agent, or Firm*—McAndrews, Held & Malloy, Ltd.

[57] ABSTRACT

A personal alarm which is compact, portable and fashionably designed. In one embodiment, this personal alarm is structurally incorporated into a wrist watch with the alarm components arranged thereon in a fanciful yet highly functional manner. This alarm may also be structurally incorporated into other conventional items such as a bracelet, pendant, necklace, keychain ornament, or any other conventional item which is often carried by the persons to be protected. In a further embodiment, the compact size is achieved without sacrificing intensity in the alarm signal by incorporating a specially wound autotransformer and an efficient switching device so as to provide a tuned warbling signal upon a piezoelectric transducer. Additionally, the alarm may be activated or deactivated by manually actuating an actuator, such as a switch or plurality of switches, in a particular sequence.

16 Claims, 2 Drawing Sheets

MANUALLY ACTUATABLE WRIST ALARM HAVING A HIGH-INTENSITY SONIC ALARM SIGNAL

This is a continuation of application Ser. No. 07/800,378, filed December 3, 1991, U.S. Pat. No. 5,258,746.

TECHNICAL FIELD

The present invention relates to a portable high-intensity sonic alarm which is manually actuatable to deter potential perpetrators of violence, and more particularly, relates to a personal alarm that is disguised as or housed within a wrist watch, piece of jewelry or any other conventional item that can be worn or easily carried by a potential victim.

Background of the Invention

Heretofore, a variety of devices have been used for protecting a potential victim from a potential perpetrator of crime. These devices can basically be broken into two categories. The first category includes offensive devices such as MACE brand chemical irritant, stunguns, and revolvers. To stop a perpetrator of crime, an offensive device must be carried, located, armed, aimed and fired with accuracy by an often panic-stricken, potential victim. This is not an easy task considering the inherent problems associated with offensive devices.

Specifically, most offensive devices cannot be conveniently carried at all times and are often intentionally left behind even though needed. Similarly, being victimized does not usually dominate the mind of the potential victim. As a result, such devices are often unintentionally left behind. Furthermore, potential victims do not want to appear fearful of potential perpetrators and might intentionally leave behind personal protection devices which give such appearances.

Even when carried, offensive devices are often not easily located. Such devices are often jumbled within a purse making access time consuming to a point of failure. Similarly, searching for these devices in pockets, socks or other hiding places might cost precious time when one could instead be running away.

Arming such offensive devices, especially in the dark, also poses serious problems to the panicking victim. Yet without effective arming mechanisms, accidental triggering might occur, yielding potentially devastating consequences.

Once armed, a panic stricken, potential victim using an offensive weapon regularly fails to aim and fire with accuracy. Even when successful, the victim suffers dire consequences if the application of the offensive weapon is wrongful. For all of these reasons such offensive devices are inherently undesirable and prone to fail.

Moreover, seeing that a potential victim is attempting to use an offensive weapon, a perpetrator is likely to react by inflicting an elevated level of harm onto the victim. The perpetrator may also react by attempting to gain control of the victim's offensive device before it can be used. Once in the perpetretor's possession, the device might be used against the victim.

Defensive devices are the second category of personal protection devices which include both audible and telemetered alarms. Although known defensive devices alleviate the problems associated with aiming and firing, such devices are still subject to the other problems which plague offensive devices, while providing a few new problems of their own.

For example, many defensive devices fail to provide easy intentional triggering while preventing accidental triggering. Similarly, once triggered, most of these devices fail to prevent the perpetrator from disabling the devices while still providing the potential victim with the capability to reset the device. In addition, many defensive devices can be easily taken from the victim and disabled by: 1) the mere action of taking possession; 2) tossing the device away from the scene of the crime; 3) disconnecting the power source; or 4) smashing the device on the ground.

More specifically, telemetered alarms transmit ultrasonic, infrared or radio frequency signals to a remote receiver. The receiver responds by providing notification to the police who might also track the signal. Yet, even though such systems do aid in the apprehension of the perpetrator, they do not provide the immediate deterrent effect that an offensive device provides. As a result, the crime often still occurs. Additionally, because these telemetered systems do not operate outside of the limited reception range of the remote receiver, they do not provide adequate performance where the wearer is highly mobile.

Unlike the telemetered alarm, known audible alarms do offer immediate deterrence yet again create further problems. Audible alarms are either electrically powered or take the form of a whistle or air horn. Whistles and air horns can easily be taken from the potential victim. Once taken, these devices are immediately disabled, and thus only provide a brief period of deterrence. Thereafter, the perpetrator can complete the crime.

Electrically powered, audible alarms are known that effectively protect personal property. Such alarms, however, are not easily adaptable for portable use by a potential victim for several reasons. First, alarm systems which protect material objects such as buildings or motor vehicles are rather large, bulky and not portable. They are specifically designed without space constraints in mind because of the adequate size of the facility in which they are housed.

Secondly, the desire for a high-intensity audible output takes precedent over size. To effectively provide personal protection, the alarm signal must be loud enough to draw the attention and assistance of others and, as an added advantage, to irritate the ear of the potential perpetrator. Large speakers and signal amplifiers are used to generate such high-intensity sound.

Thirdly, such large speakers and signal amplifiers require a relatively large amount of power. This power requirement is accomplished with the utilization of house current or car batteries, making the alarm system difficult or impossible to carry or wear.

Even those electrically powered, known audible alarms which purport to provide effective personal protection fail to solve a variety of the problems enumerated above. It would be highly desirable to have an audible alarm which provides a high-intensity alarm sound for protecting a potential victim from perpetrators of crime and which solves these problems.

It is therefore an object of the present invention to provide a portable high-intensity sonic alarm which cannot be used by the potential perpetrator against the potential victim, or cannot be mistakenly used by the potential victim to cause detrimental consequences.

It is therefore an object of the present invention to provide a portable high-intensity sonic alarm which does not create an appearance of fearfulness and can be conveniently carried by a potential victim in a location that can easily be accessed even in the dark, while being unlikely to be unintentionally left behind.

It is a further object of the present invention to provide a portable high-intensity sonic alarm that can be intentionally turned ON quickly and easily without impeding the potential victim's ability to flee, yet is difficult to accidentally turn ON.

It is another object of the present invention to provide a portable high-intensity sonic alarm that is very difficult for a perpetrator of crime to turn OFF, while still providing the potential victim with a method of turning the alarm OFF.

It is yet another object of the present invention to provide a portable high-intensity sonic alarm which provides an immediate deterrent effect for the highly-mobile, potential victim.

It is another object of the present invention to provide a portable alarm which produces a sonic alarm signal of such high-intensity as to draw the attention and assistance of others.

It is another object of the present invention to provide a high-intensity sonic alarm which is not only extremely portable, but is also designed so as to be desirable to wear from a fashion standpoint.

It is a further object of the present invention to provide a portable high-intensity sonic alarm that accomplishes the foregoing objects and is disguised as a wrist watch, bracelet or conventional item.

SUMMARY OF THE INVENTION

These and other objects of the present invention are achieved in a portable personal alarm system. The alarm system of the present invention can be easily carried by a potential victim. Upon manual actuation, a high-intensity sonic alarm signal is produced to deter potential perpetrators of violence. In one embodiment, a wrist alarm comprises a band which encircles the wrist of a potential victim and carries batteries and an electronic circuit housing. The housing is covered by a face plate and contains electronic alarm circuitry and an auditory speaker for producing the high-intensity alarm signal. The alarm signal is communicated through a sound passageway to the exterior of the housing. A pair of switches are positioned so as to respond to the application of simultaneous opposing forces for activating the alarm. The power unit is separated into a plurality of batteries disposed outside of the housing and along the lower portion of the band.

DESCRIPTION OF THE PREFERRED EMBODIMENT

Figure 2:
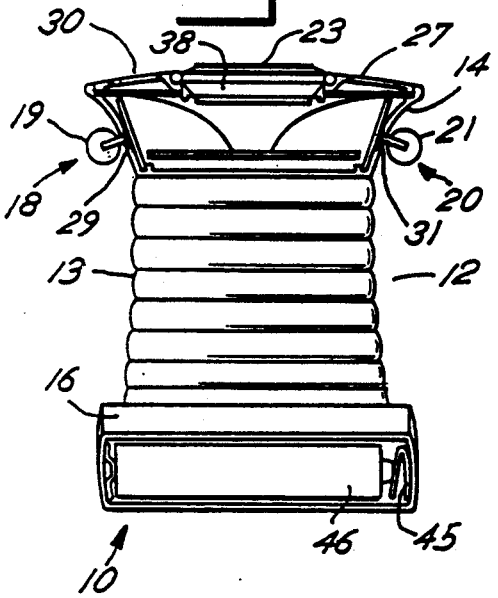
FIG. 2 is a cross sectional side view of the wrist alarm of FIG. 1.
Figure 4:
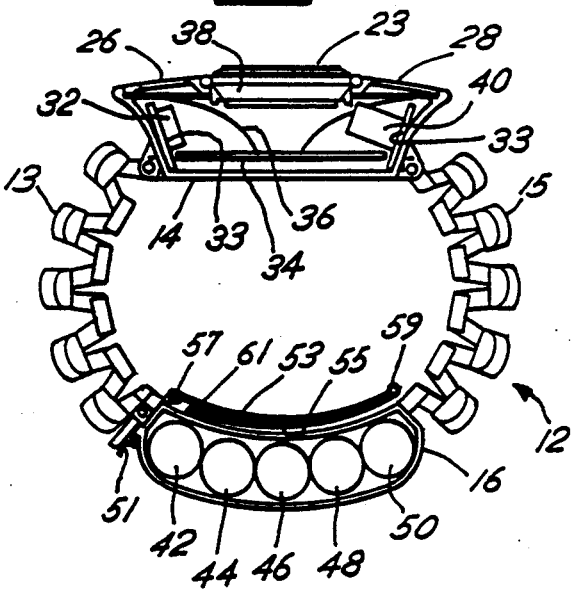
FIG. 4 is a cross sectional front view of the wrist alarm of FIG. 1.

Referring to FIGS. 2 and 4, a wrist alarm 10 includes a band 12, a circuit housing 14, and a battery casing 16. Band 12 is formed of two separate band sections 13,15 which carry battery casing 16. As shown, band sections 13,15 are of a flexible band design, but need not be. One or both may be of a more rigid design. Band sections 13,15 are of a length to permit alarm 10 to fully encircle a wrist of a wearer, i.e., a potential victim. Alternatively, band 12 may serve to partially encircle the wrist but to such a degree as to secure the alarm 10 to the wrist. It is preferred that the attacker or perpetrator should not be able to strip the alarm from the wearer's wrist.

Battery casing 16 houses a plurality of batteries 42,44,46,48,50 necessary to power the wrist alarm. The geometric shape of these batteries governs the size and construction of battery casing 16, and this shape may be utilized to provide a decorative construction which is stylish and appealing to the user. In the preferred embodiment, battery casing 16 is disguised as a typical clasp found on watches or bracelets.

In the alternative, battery casing 16 may be formed of a number of discrete battery cases placed at different locations along the band so that each discrete case contains only a single battery or some portion of the total number of batteries used. Similarly, battery casing 16 might be formed within the band using a flexible battery construction such that the entire band, or substantial portion thereof, constitutes the battery casing. It is also contemplated that the batteries might also be placed within housing 14, wherein the housing would constitute the battery casing.

In the preferred embodiment, one side of battery casing 16 is directly connected to band section 15 while the other side is indirectly connected to band section 13. In particular, to make this indirect connection, a pivot joint 57 attaches a hinge 53 to band section 13, a pivot joint 59 attaches hinge 53 to a hinge 55, and a pivot joint 61 attaches hinge 55 to battery casing 16. During normal wear, in conjunction with hinges 53,55 and pivot joints 57,59,61, a latch 51 holds one end of battery casing 16 against band section 13. In this way, battery casing 16 is held snugly in place on the wrist of the wearer.

Upon releasing latch 51, battery casing 16 folds out and away from the wrist, pivoting at joint 59 causing hinges 53 and 55 to separate. The inner circumference of band 12 is then expanded as pivot joint 59 moves away from band section 15. The band is expanded by about the total length of hinges 53 and 55. The total length of hinges 53 and 55 is chosen so that wrist alarm 10 can then be removed when the wearer's hand is open, but not when the wearer makes a fist. Therefore, making a fist prevents the perpetrator of crime from being able to take wrist alarm 10 away from the wearer.

To remove the wrist alarm 10, the perpetrator must either force the victim's hand open or overcome the material strength of band section 13 or 15, hinges 53 or 55 or pivot joints 57, 59 or 61. Although not shown, instead of relying on the material strength of these components, a wrist encircling safety wire might be added to the band. This safety wire could be sized so as to only fit over the open hand of the potential victim, but not the closed fist. Such a safety wire could be hidden within band 12 or could run along the inner circumference thereof. The safety wire could also be securely attached to housing 14 so that housing 14 cannot be removed from the wearer's wrist.

Additional features for preventing unwanted removal of wrist alarm 10 are also contemplated. For example, a locking clasp requiring a key might also be used. Similarly, a mechanism which reacts to the expansion of the wearers wrist by tightening or disabling the releasability of latch 51 might also be implemented.

As shown in FIG. 2, two push button switches 18,20 respond to a simultaneous depression by the wearer for actuating the wrist alarm. In the preferred embodiment, switches 18,20 are located on opposite sides of housing 14 for easy access. Simultaneous depression of switches 18,20 is accomplished by applying a pinching force to the switches using the finger and thumb. Requiring simultaneous opposed depression is preferred because it prevents the unintentional actuation of the wrist alarm 10. Additionally, switches 18,20 may be located at other places on wrist alarm 10 in any area which is easily accessible.

More particularly, switch 18 consists of a plunger 19 and a membrane switch 29. Similarly, switch 20 consists of a plunger 21 and a membrane switch 31. Normally, membrane switches 29,31 are in an open or non-conducting state and are mounted on the back side of a flexible circuit board 33. Depressing plunger 19 or 21 forces membrane switch 29 or 31 into a closed or conducting state, respectively. As will be discussed below, simultaneously depressing both plungers 19 and 20 causes the activation of the alarm.

The use of other single or multiple switching configurations is contemplated. For example, a coded sequence of single or multiple button depressions might be used. Such a coded sequence could be carried out using a visual display situated at some convenient location upon wrist alarm 10. Other types of switches might also be used such as toggle, slide or threshold pressure switches. Additionally, the preferred use of a "pair" of switches as defined herein is meant to further include both a single switch arrangement requiring simultaneous depression of two buttons for activating the single switch.

Figure 1:
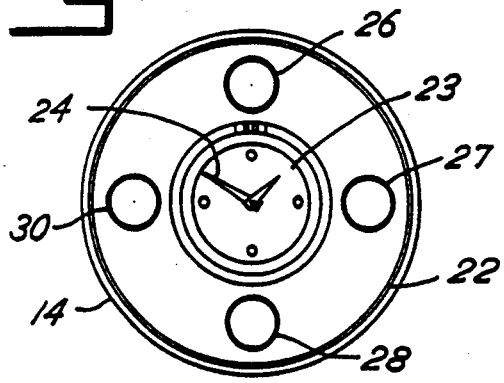
FIG. 1 is a top view of a wrist alarm embodiment of the present invention.

Referring to FIG. 1, face plate 22 is mounted onto the top of housing 14, forming a closed cavity therein. Face plate 22 is removable so as to provide access to the interior of housing 14 for both assembly and repair purposes. Although such a configuration is preferable, face plate 22 need not be removable. Instead, face plate 22 might be molded onto housing 14, and the needed access might be provided by some removable portion of housing 14.

The face area of face plate 22 depicts a watch face 23. A pair of watch hands 24 cooperate with watch face 23 or other indicia on face plate 22. Also located thereon are four separate apertures 26,27,28,30 which pass through face plate 22 to the interior of housing 14. These apertures 26,27,28,30 are decoratively placed at the 12:00 clock, 3:00 o'clock, 6:00 o'clock and 9:00 o'clock positions relative to hands 24. Although describing analog technology as shown, the watch face 23 and hands 24 are meant to embody digital technology as well. Specifically, hands 24 might be represented using liquid crystal displays (LCD's) or light emitting diode (LED) displays which mimic the analog version of watch hands. Similarly, a numerical read-out using LCD's or LED displays might represent hands 24.

Although not shown, jewelry designs might be added to enhance the presentation of face plate 22. In fact, watch face 23 and hands 24 might be fully replaced by a jewelry design converting wrist alarm 10 into a fashionable alarm bracelet. Similarly, one might place an exercise monitoring display on face plate 22 to satisfy potential victims who exercise outdoors.

The term "high-intensity" as defined herein constitutes a sound level of over 105 decibels at a range of two to three feet. Wrist alarm 10 produces a high-intensity sonic alarm signal of the order of 113 decibels at this range. This 113 decibel signal not only alerts potential rescuers within hearing range, but also provides a great deal of discomfort to the potential perpetrator. Proximate exposure to this alarm signal causes an almost unbearable resonance in the ears of the listener, and will cause a loud ringing in a listener's ears well after such exposure has ended.

More specifically, apertures 26,27,28,30 provide a sound passageway which delivers the sonic alarm signal originating from within housing 14 to the potential perpetrator. These apertures 26,27,28,30 are cylindrical in shape and have a diameter of approximately one quarter of an inch. The shape and number of these apertures may be changed as long as the effective sound passageway area is maintained. The sound passageway might also be placed at any variety of locations upon housing 14 such as on the sides thereof, or the entire face plate 22 or housing 14 could become the sound passageway by constructing them out of a material, such as Mylar brand polymer material, possessing a sufficient degree of acoustic transparency. Such material might also be used to cover apertures 26,27,28,30, providing an added benefit of helping to water-proof wrist alarm 10. Similarly, a mesh could be used to cover the apertures, preventing particles from falling into the cavity of housing 14 while maintaining the sound passageway. Although this mesh might be made out of metal, a material such as GORTEX brand fabric might also be used, adding a degree of water-resistance.

Figure 3:
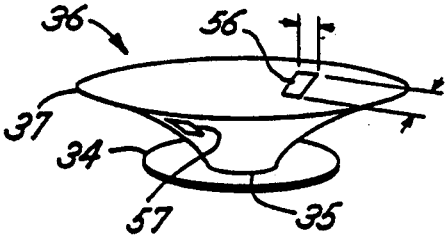
FIG. 3 is a perspective view of a vibratable diaphragm and piezoelectric transducer assembly of the wrist alarm of FIG. 1.

Referring to FIGS. 3 and 4, a vibratable diaphragm 36 has an outer rim 37 which is affixed at the interface of face plate 22 and housing 14, while the inner rim 35 of diaphragm 36 is affixed to a piezoelectric transducer 34. This assembly permits both piezoelectric transducer 34 and the inner portion of diaphragm 36 to float within housing 14.

Figure 5:
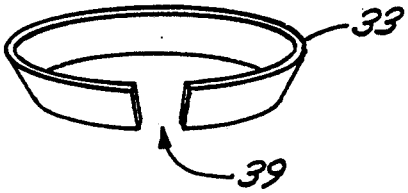
FIG. 5 is a perspective view of a flexible circuit board of the wrist alarm of FIG. 1.

Surrounding a middle portion of diaphragm 36, but not interfering with its ability to float, is positioned flexible circuit board 33 which is fixed to the inner wall of housing 14. Circuit board 33 is shaped so as not to interfere with movement of diaphragm 36 and follows the inner wall of housing 14 in a conical manner. This shape is more particularly shown in FIG. 5. As can be seen, a wedge area 39 of circuit board 33 is removed to permit easier assembly when board 33 is positioned around the middle portion of diaphragm 36.

An electronic alarm circuit 32 and membrane switch 29,31 are mounted onto flexible circuit board 33. Although surface mount technology is preferred for space minimization, alarm circuit 32 may also be composed of discrete components. Alarm circuit 32 also includes an autotransformer 40 which protrudes through removed areas 56 and 57 (FIG. 3) of diaphragm 36.

In the preferred embodiment, removed areas 56 and 57 are symmetrically located approximately half way up the side of diaphragm 36, and each possesses the optimized surface area of about 0.04 to 0.0625 inches squared, for a total removed area of 0.08 to 0.125 inches squared. Although the shapes of these removed areas are not critical, they were chosen so as to provide a sufficient rectangular opening for autotransformer 40 to protrude. It is further contemplated that removed areas 56 and 57 might also be used to permit other components to so protrude, or might be used to provide structural, electrical or mechanical pathways from components disposed above the diaphragm 36 to those disposed below.

Because autotransformer 40 protrudes through removed areas 56 and 57, a more densely packed assembly is achieved. Moreover, removed areas 56 and 57 do not attenuate the alarm signal, but, instead, have demonstrated the opposite effect of increasing the intensity. When the total area removed becomes larger or smaller than the range disclosed, attenuation in the alarm signal occurs.

Electronic alarm circuit 32 possesses both an ON and an OFF condition. In its OFF condition, electronic alarm circuit 32 is in a dormant state. Once switches 18,20 are simultaneously depressed, electronic alarm circuit 32 enters its ON condition generating the sonic alarm. In its ON condition, alarm circuit 32 produces a stepped up oscillating electric signal which drives piezoelectric transducer 34. Piezoelectric transducer 34 vibrates, forcing the attached vibratable diaphragm 36 into vibration resulting in a high-intensity audio sonic alarm signal. The shape of vibratable diaphragm 36 acts to focus the audio alarm signal which passes through the sound passageway provided by apertures 26,27,28,30. As will suggest itself, auditory speakers other than a piezoelectric transducer may be used.

A timepiece circuitry 38 is mounted immediately below watch face 23 and may contain mechanical and electrical components for moving hands 24. In other words, analog or digital or a mixture of the two technologies might be used. Alternatively, timepiece circuitry 38, or any portion thereof, may be mounted together with electronic alarm circuit 32 on flexible circuit board 33 or elsewhere within housing 14.

Most importantly, utilizing this overall construction, housing 14 has been reduced in size to a mere two inches in diameter by about one half of an inch in depth. This has been accomplished without sacrificing the necessary intensity of the alarm signal or any wrist alarm functionality. Thus, the term "compact" as used herein describes an alarm which is small enough to give the appearance of the corresponding conventional item without sacrificing necessary alarm signal intensity, while maintaining wearability and stylish design.

The plurality of batteries 42,44,46,48,50 provide the power for wrist alarm 10. Although quadruple A (AAAA) batteries are preferred because they follow the contour of the wrist with minimal thickness, other batteries which are small and possess low source resistance can be used. Other batteries need not be chemical in nature but, for example, could involve solar or nuclear power generation. Further, a "plurality" of batteries as used herein is intended to encompass the utilization of a single battery so long as the overall size, shape and power requirements defined by wrist alarm 10 can be met. When using the preferred quadruple A batteries, only about three of them are necessary to enable basic functionality. Five quadruple A batteries was found most effective in balancing the desire to maximize the intensity and duration of the alarm signal with the desire to minimize bulkiness.

Specifically, batteries 42,44,46,48,50 are connected to electronic alarm circuit 32 via two electrical conductors (not shown) which are hidden within band 12. These conductors may also be decoratively disguised as the band itself or any part thereof. Upon installation of batteries 42,44,46,48,50 into battery casing 16, alarm circuit 32 enters the OFF condition until actuated into the ON condition by switches 18,20. Once actuated, the alarm signal continues until: (1) either the batteries are dead, i.e., fail to provide enough energy to meet the minimum power requirements of alarm circuit 32; or (2) alarm circuit 32 is reset into the dormant OFF condition. The batteries will die and terminate the alarm signal after a minimum of approximately thirty (30) minutes due to normal energy drain. Resetting alarm circuit 32 occurs when one of the batteries from battery case 16 is removed, i.e., when the power source is temporarily disconnected. An electrical contact 45 is releasably disposed against battery 46 for releasing contact with battery 46 to place the alarm circuit in the OFF condition. This may also be accomplished by disconnecting one of the two conductors (not shown) or other electrical pathway such as that found within alarm circuit 32 with a switch or set of switches placed at a location upon wrist alarm 10 which is not easily accessible by the potential perpetrator of a crime. In addition, circuitry may be added to alarm circuit 32 which will monitor a particular pressure sequence or code using switches 18,20 for terminating the alarm signal.

Figure 6:
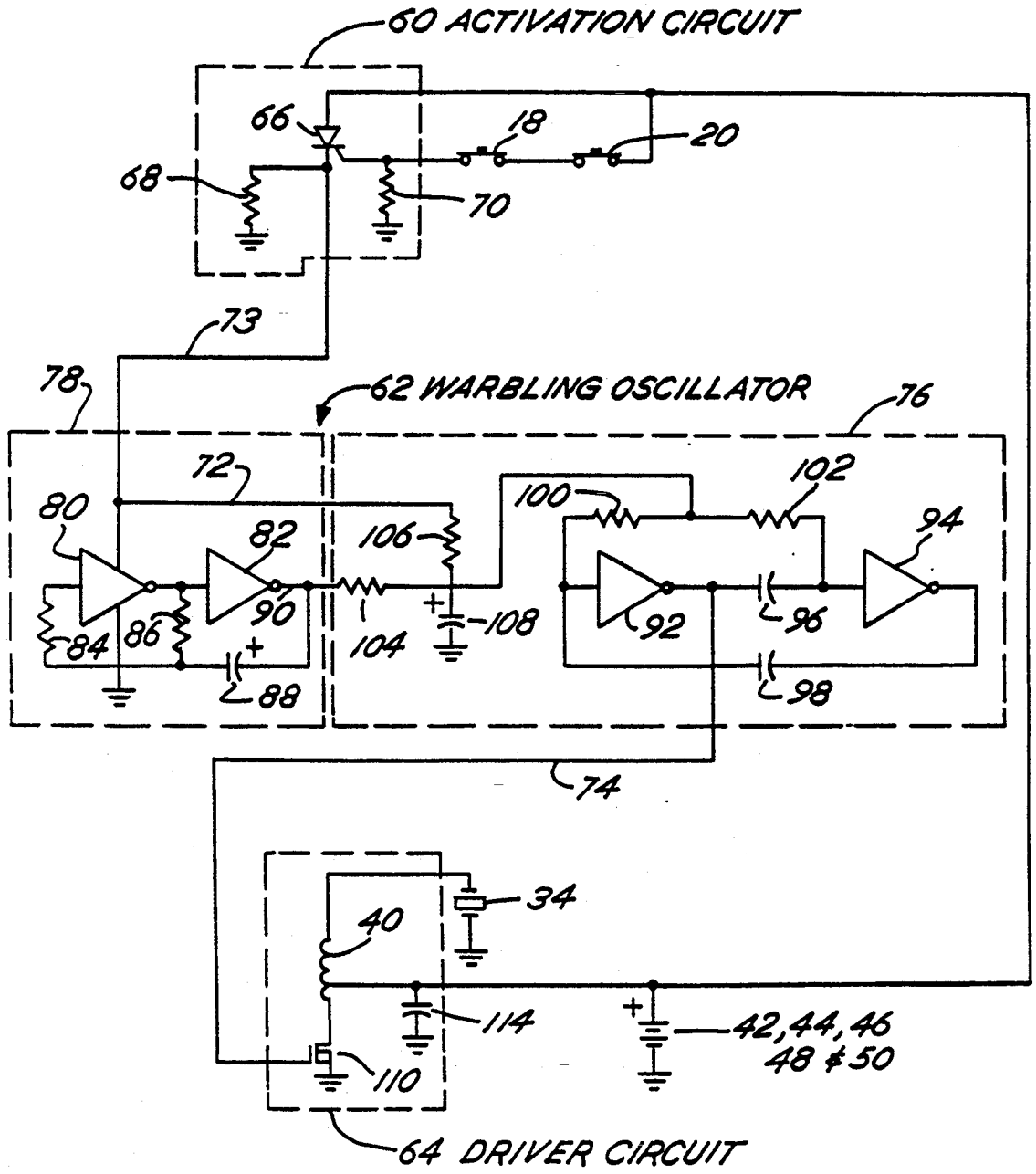
FIG. 6 is a schematic diagram of an electric circuit of the wrist alarm of FIG. 1.

Referring to FIG. 6, electronic alarm circuit 32 comprises an activation circuit 60, a warbling oscillator 62 and a driver circuit 64. Activation circuit 60 responds to simultaneous actuation of switches 18,20 by providing a current pathway to power warbling oscillator 62 from batteries 42,44,46,48,50 (schematically shown as a single, multi-celled battery). Warbling oscillator 62 responds to power by producing a digitally warbling electrical oscillation signal along a conductor 74. Driver circuit 64 responds to the oscillation signal by generating a high-intensity alarm signal via piezoelectric transducer 34.

More specifically, the simultaneous depression of switches 18,20 applies the battery voltage to the gate of a silicon controlled rectifier ("SCR") 66. SCR 66 responds by providing a current pathway from its anode to its cathode connecting batteries 42,44,46,48,50 to warbling oscillator 62. A resistor 68, connected between the cathode of SCR 66 and ground, draws sufficient "holding current" through SCR 66 to keep it conducting. This is necessary because warbling oscillator 62 does not draw a sufficient "holding current" alone. In addition, a resistor 70 prevents accidental triggering of SCR 66 when batteries 42,44,46,48,50 are initially inserted into battery casing 16.

To disable SCR 66 once it has been triggered, the current flowing from the anode to the cathode of SCR 66 must fall to a level below the "holding current", permitting SCR 66 to recover. This occurs whenever one of the batteries 42,44,46,48,50 is removed from battery casing 16 or whenever the batteries have nearly discharged.

Once activation circuit 60 is actuated, nearly the full voltage of the sum of batteries 42,44,46,48,50 is applied to warbling oscillator 62 along conductor 73. Warbling oscillator 62 includes a base oscillator 76 and a lower-frequency modulating oscillator 78. Base oscillator 76 is tuned to oscillate at a base frequency which is equal to the resonant frequency of piezoelectric transducer 34 which is approximately 3000 Hertz. Lower-frequency modulating oscillator 78 oscillates at about 14 Hertz—a frequency chosen based on what sounds most annoying to the human ear. Base oscillator 76 responds to lower-frequency modulating oscillator 78 by varying its frequency of oscillation around the resonant frequency of piezoelectric transducer 34. In other words, lower-frequency modulating oscillator 78 modulates the higher base frequency generated by base oscillator 76, producing a warbling square-wave signal along conductor 74.

Lower-frequency modulating oscillator 78 is constructed of a typical digital oscillator comprising inverters 80,82, resistors 84,86, and a capacitor 88 connected as shown. Capacitor 88 and resistor 86 together define and control the charging and discharging pathway which determine the frequency at which lower-frequency modulating oscillator 78 oscillates. Inverter 82 responds directly to the output of inverter 80 which, in turn, responds indirectly via the charging and discharging pathway to the output of inverter 82. This can be seen when considering that resistor 84 operates to tap off the reference voltage defined by the interface of capacitor 88 and resistor 86. This reference voltage will follow typical RC charge or discharge times defined by resistor 86 and capacitor 88. Additionally, resistor 84 which taps this reference voltage is chosen at a value high enough so as to prevent interference with the charging and discharging pathway. As a result, lower-frequency modulating oscillator 78 produces a square-wave low-frequency signal along conductor 90.

Base oscillator 76 comprises inverters 92,94, capacitors 96,98,108 and resistors 100,102,104,106 connected as shown. The low frequency signal generated along conductor 90 by oscillator 78 is referenced and filtered through resistors 104,106 and capacitor 108. This referenced and filtered signal is used to control, in a warbling manner, two charge and discharge pathways. A first charge and discharge pathway is defined by resistor 100 along with capacitor 98; a second charge and discharge pathway is defined by resistor 102 along with capacitor 96. Additionally, inverter 92 is responsive to both inverter 94 and the first charge and discharge pathway; inverter 94 is responsive to both inverter 92 and the second charge and discharge pathway. As a result, a warbling square-wave output signal of a digital nature is generated on conductor 74.

Driver circuit 64 responds to the warbling signal along conductor 74 by stepping up that signal and applying the stepped-up signal to piezoelectric transducer 34. Specifically, a field effect transistor ("FET") 110 responds to the signal on conductor 74 by controlling a current pathway to piezoelectric transducer 34 via autotransformer 40. When the warbling signal on conductor 74 is at a HIGH logic level, FET 110 turns ON, providing a very low channel resistance so that the current flowing through the primary coil of autotransformer 40 is maximized. When the signal on conductor 74 switches to a LOW logic level, FET 110 turns OFF, providing a very high channel resistance which stops the current flow through the primary coil. In this manner, the warbling signal generated on conductor 74 is reflected in the primary coil of autotransformer 40. The secondary coil of autotransformer 40 responds by stepping up this signal and applying the stepped up signal to piezoelectric transducer 34 which produces a very intense audio alarm signal.

For optimal performance in this design, resistive losses in the high-current pathway of the primary coil of autotransformer 40 must be minimized. Thus, the specific FET 110 should be chosen to have the lowest ON channel resistance possible. Similarly, the primary coil of autotransformer 40 should be wound with a large-diameter wire in order to minimize resistive losses. The limiting factor on this diameter will be the size constraints defined by the device structure. Minimization of these resistive losses in the high-current pathway not only eliminates heat dissipation problems, but also prevents the wasting of energy from batteries 42,44,46,48,50.

The secondary of autotransformer 40 does not have such high-current requirements as does the primary. In fact, the secondary current is very small. Because of this, the secondary can be wound with a very small diameter wire, reducing the overall size of autotransformer 40.

In an autotransformer that was used to practice this invention, the following build sheet specifications were used: 1) 150 turns of 38 gauge wire on the primary—#38 SN; 2) 600 turns of 44 gauge wire on the secondary—#44 SN wire; 3) a bobbin coil form—Cosmo #7001-0; 4) 26 gauge tinned copper leads; 5) over insulation—2L 0.001 MY; and 6) the lamination stack being F-094 or E1-094, 0.014 inches, 49 alloy, 1×1.

Additionally, the energy delivered by batteries 42,44,46,48,50 is smoothed by capacitor 114 which helps to maintain the voltage level at which energy is delivered and also to insure proper performance from all of the circuitry.

With respect to the components identified in the circuitry shown in FIG. 6, the following values are given:

| Capacitor | (micro-farads) |
|---|---|
| 88 | 1.0 |
| 96 | 0.33 |
| 98 | 0.33 |
| 108 | 22 |
| 114 | 10.0 |
| **Resistor** | **(kilo-ohms)** |
| 68 | 0.47 |
| 70 | 1.0 |
| 84 | 220 |
| 86 | 33 |
| 100 | 560 |
| 102 | 560 |
| 104 | 5.6 |
| 106 | 1.5 |
| **Component** | **Device Number** |
| FET 110 | MTD10ND05E |
| SCR 66 | MMBS5062L |
| Inverters: 80, 82, 92, 94 | CD4069 |
| Piezoelectric transducer 34 | Motorola 1157KSN |
| Batteries: 42, 44, 46, 48, 50 | Eveready AAAA-#96, 1.5V |

Although the preferred embodiment disclosed is that of a personal alarm disguised as a conventional wrist watch or bracelet, the present invention may take many forms. Further embodiments utilizing the structure of a pendant, necklace, key-chain ornament, portable radio, or other conventional item may be used as the structure for containing the alarm circuitry, auditory speaker, and batteries described herein. The conventional item would normally be very portable and of a type often carried by the potential victim.

The term "disguised" as used herein is directed toward the potential victim, not the potential perpetrator of crime. In other words, any alarm component which is unattractive should be fashionably hidden from the potential victim. Such a disguise can either utilize the full functionality of a conventional item, or completely replace such functionality, merely utilizing the structure of that item as a facade for the alarm.

Additionally, it is obvious that the embodiments of the present invention described hereinabove are merely illustrative and that other modifications and adaptations may be made without departing from the scope of the appended claims.

What is claimed is:

1. A personal alarm having an electronic alarm circuit, said alarm circuit being placeable into an ON condition in which an alarm sounds and an OFF condition, said personal alarm further comprising:

an actuator being manually actuable for placing said alarm circuit into one of said conditions; and said alarm circuit including:

an actuation circuit responsive to manual actuation of said actuator for placing said alarm circuit into said one of said conditions;

an oscillator for producing an oscillating signal;

a switch means responsive to said oscillating signal for switching between an OFF state and an ON state;

an autotransformer responsive to said switch means for providing a stepped up signal generated in accordance with said oscillating signal; and an auditory speaker responsive to said stepped-up signal for producing a high-intensity sonic alarm signal having an intensity of at least 105 dB at a distance of 2 feet from said alarm circuit.

2. The personal alarm of claim 1 wherein said actuator generates a code signal in response to manual actuation.

3. The personal alarm of claim 2 wherein said actuator includes a depressable member, said actuator generating said code signal in response to a sequence of manual depressions of said depressable member.

4. The personal alarm of claim 3 wherein said actuator includes a visual display that is responsive to manual depression of said depressable member.

5. The personal alarm of claim 1 wherein said actuator is a toggle switch.

6. The personal alarm of claim 1 wherein said actuator is a slide switch.

7. The personal alarm of claim 1 wherein said actuator is a threshold pressure switch.

8. The personal alarm of claim 1 wherein said actuator generates a code upon manual actuation and wherein said actuation circuit monitors said code.

9. The personal alarm of claim 1 wherein said one of said conditions is said OFF condition.

10. The personal alarm of claim 9 wherein said actuator generates a code signal in response to manual actuation.

11. The personal alarm of claim 10 wherein said actuator includes a depressable member, said actuator generating said code signal in response to a sequence of manual depressions of said member.

12. The personal alarm of claim 11 wherein said actuator includes a visual display that is responsive to said sequence of manual depressions of said depressable member.

13. The personal alarm of claim 9 wherein said actuator is a toggle switch.

14. The personal alarm of claim 9 wherein said actuator is a slide switch.

15. The personal alarm of claim 9 wherein said actuator is a threshold pressure switch.

16. The personal alarm of claim 9 wherein said actuator generates a code upon manual actuation and wherein said actuation circuit monitors said code.

* * * * *